US007877180B2

(12) United States Patent
Turner et al.

(10) Patent No.: US 7,877,180 B2
(45) Date of Patent: Jan. 25, 2011

(54) AUTOMATIC WINDOW REPOSITIONING TO RELIEVE VEHICLE PASSENGER CABIN WIND PRESSURE PULSATION

(75) Inventors: Phillip M. Turner, Montrose, MI (US); Yueh-Se J. Huang, Ann Arbor, MI (US); Pei-Chung Wang, Troy, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 680 days.

(21) Appl. No.: 11/851,209

(22) Filed: Sep. 6, 2007

(65) Prior Publication Data

US 2009/0069984 A1 Mar. 12, 2009

(51) Int. Cl.
*E05F 15/00* (2006.01)

(52) U.S. Cl. ..... 701/49; 318/280; 318/469; 454/95

(58) Field of Classification Search ..... 701/49; 318/443, 256, 466, 282, 461, 280, 469, 266, 318/286; 49/26, 43; 454/95; *E05F 15/20*
See application file for complete search history.

(56) References Cited

U.S. PATENT DOCUMENTS

| | | | | |
|---|---|---|---|---|
| 5,399,950 | A * | 3/1995 | Lu et al. | 318/565 |
| 5,422,551 | A * | 6/1995 | Takeda et al. | 318/265 |
| 5,436,539 | A * | 7/1995 | Wrenbeck et al. | 318/265 |
| 5,530,329 | A * | 6/1996 | Shigematsu et al. | 318/469 |
| 5,539,290 | A * | 7/1996 | Lu et al. | 318/565 |
| 5,723,960 | A * | 3/1998 | Harada | 318/469 |
| 6,426,604 | B1 * | 7/2002 | Ito et al. | 318/466 |
| 6,484,082 | B1 * | 11/2002 | Millsap et al. | 701/48 |
| 7,183,733 | B2 * | 2/2007 | Suzuki et al. | 318/282 |
| 7,482,773 | B2 * | 1/2009 | Heyn | 318/443 |
| 7,646,158 | B2 * | 1/2010 | Suzuki et al. | 318/280 |
| 2006/0208676 | A1 * | 9/2006 | Adachi et al. | 318/256 |
| 2007/0106430 | A1 * | 5/2007 | Goto et al. | 701/1 |

* cited by examiner

*Primary Examiner*—Tuan C To
(74) *Attorney, Agent, or Firm*—Ingrassia Fisher & Lorenz, P.C.

(57) ABSTRACT

Methods and apparatus are provided for the detection of conditions indicative of a wind pressure pulsation within the passenger cabin of a vehicle, and for the reduction of the intensity of the pressure pulsation via automatic window repositioning. The apparatus comprises vehicle sensors for detection of a pressure pulsation condition, controllers to process sensor data and issue commands, and power-operated vehicle windows.

12 Claims, 3 Drawing Sheets

AUTOMATIC WINDOW REPOSITIONING TO RELIEVE VEHICLE PASSENGER CABIN WIND PRESSURE PULSATION

TECHNICAL FIELD

The present invention generally relates to passenger cabin control systems for vehicle applications, and more particularly relates to a system and methods that leverage onboard sensors and controls to detect and then reduce a wind pressure pulsation within the passenger cabin of the vehicle.

BACKGROUND OF THE INVENTION

While traveling in a vehicle, passengers commonly experience a rapid, buffeting air pressure pulsation when one or more windows of the vehicle is opened while the vehicle is traveling at speed. The pressure pulsation can be experienced as both a physical and an audible vibration. This vibration can be a discomfort to passengers and a distraction to the driver.

The intensity of the vibration is influenced by the aerodynamic properties of the vehicle. Passengers in some vehicle models may not experience the effects of the pressure pulsation, whereas passengers of other vehicle models may experience such effects to respectively varying degrees. Vehicles with large passenger cabins, such as sport utility vehicles (SUVs), often have multiple rows of side windows, and may exhibit particularly excessive wind pressure pulsations inside the passenger cabin when the vehicle is traveling at speed and one or more of the rear side windows of the vehicle are lowered when the front side windows are raised. For a given model of vehicle, the onset and/or intensity of the pressure pulsation can be predicted by observing the vehicle speed and window positions.

In the SUV example above (where a wind pressure pulsation results when a rear side window is open and both front side windows are closed), the driver or a passenger can diminish the intensity of the wind pressure pulsation by slightly lowering one or both of the SUV's front side windows, thereby preventing excessive pressure buildup. In general, within the passenger cabin experiencing a wind pressure pulsation, relief can be obtained by slightly opening one or more closed windows.

SUMMARY OF THE INVENTION

An onboard system and method for detecting conditions indicative of a wind pressure pulsation within the passenger cabin of a vehicle is described herein. The system can be utilized to reduce the vibration and noise associated with the wind pressure pulsation. The system provides a real-time estimation of the existence of a wind pressure pulsation inside the passenger cabin of the vehicle, and may reposition one or more windows to non-closed positions to reduce the intensity of the pressure pulsation. In practice, the system provides improved user comfort by reducing a physical and audible irritant and improved user safety by reducing a driver distraction.

The above and other aspects of the invention may be carried out in one form by a control method for reducing a wind pressure pulsation in a vehicle passenger cabin. The method involves: reading vehicle sensor data, analyzing the sensor data to detect conditions indicative of a wind pressure pulsation within the passenger cabin, and, if the condition is detected, repositioning a window to a non-closed position to reduce the wind pressure pulsation.

The above and other aspects of the invention may be carried out in another form by a system to reduce a wind pressure pulsation in a vehicle passenger cabin. The system includes: a plurality of power windows, a power window controller to control the power windows, a plurality of window position sensors, and a vehicle speed sensor. The system also includes a control module, coupled to the power window controller, window position sensors and vehicle speed sensor. The control module receives window position data from the window position sensors and speed data from the vehicle speed sensor, and instructs the power window controller to reposition one or more of the power windows to respective non-closed positions if the window position data and speed data together indicate a wind pressure pulsation in the vehicle passenger cabin.

The above and other aspects of the invention may be carried out in another form by a method to reduce a wind pressure pulsation in a vehicle having front and rear windows, a vehicle speed sensor, and window position sensors for the rear windows. The method involves: detecting a wind pressure pulsation condition based on current speed data and rear window position data, and, in response to detecting the wind pressure pulsation condition, repositioning one or both front windows to non-closed positions to reduce the wind pressure pulsation.

DESCRIPTION OF THE DRAWINGS

The present invention will hereinafter be described in conjunction with the following drawing figures, wherein like numerals denote like elements.

DESCRIPTION OF AN EXEMPLARY EMBODIMENT

The following detailed description is merely exemplary in nature and is not intended to limit the invention or the application and uses of the invention. Furthermore, there is no intention to be bound by any expressed or implied theory presented in the preceding technical field, background, brief summary or the following detailed description.

The invention may be described herein in terms of functional and/or logical block components and various processing steps. It should be appreciated that such block components may be realized by any number of hardware, software, and/or firmware components configured to perform the specified functions. For example, an embodiment of the invention may employ various integrated circuit components, e.g., memory elements, digital signal processing elements, logic elements, look-up tables, or the like, which may carry out a variety of functions under the control of one or more microprocessors or other control devices. In addition, those skilled in the art will appreciate that the present invention may be practiced in conjunction with any number of automotive control protocols and that the system described herein is merely one exemplary application for the invention.

For the sake of brevity, conventional techniques related to vehicle body control modules, power windows, power window controllers, window position sensors, vehicle speed sensors, environment sensors, and other functional aspects of the systems (and the individual operating components of the systems) may not be described in detail herein. Furthermore, the connecting lines shown in the various figures contained herein are intended to represent example functional relationships and/or physical couplings between the various elements. It should be noted that many alternative or additional functional relationships or physical connections may be present in a practical embodiment.

Figure 2:
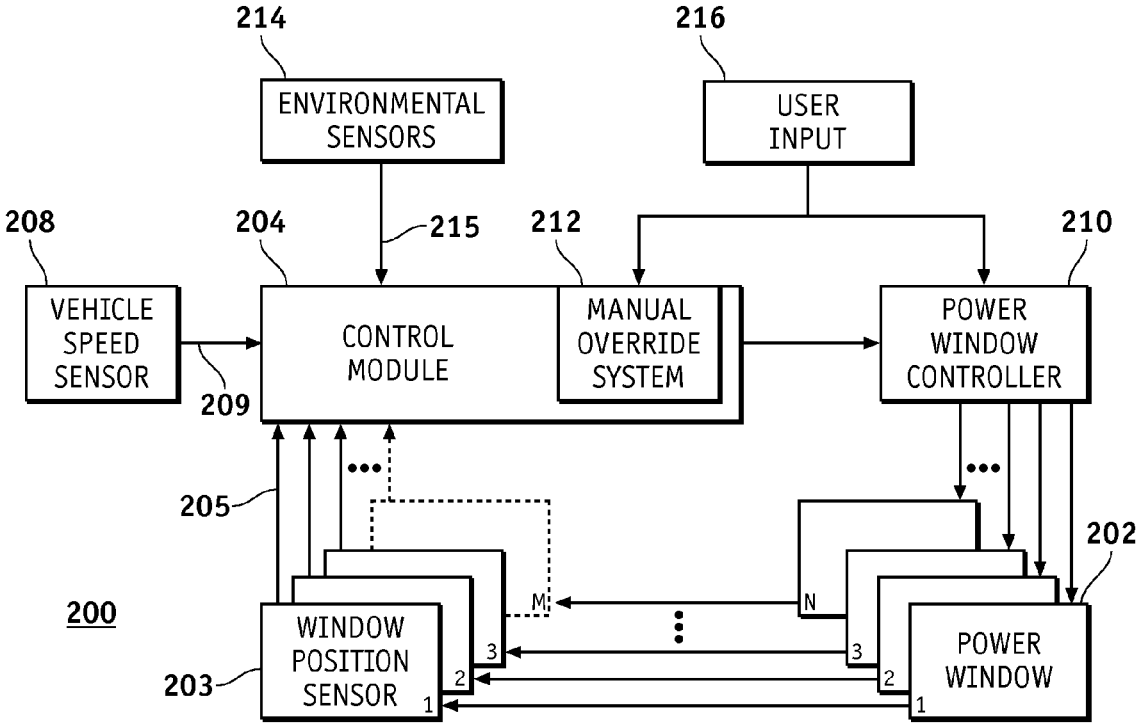
FIG. 2 is a schematic representation of an embodiment of a system for reducing a wind pressure pulsation within the passenger cabin of a vehicle.

The following description refers to elements or features being "connected" or "coupled" together. As used herein, unless expressly stated otherwise, "connected" means that one element/feature is directly joined to (or directly communicates with) another element/feature, and not necessarily mechanically. Likewise, unless expressly stated otherwise, "coupled" means that one element/feature is directly or indirectly joined to (or directly or indirectly communicates with) another element/feature, and not necessarily mechanically. Thus, although the schematic shown in FIG. 2 depicts one example arrangement of elements, additional intervening elements, devices, features, or components may be present in an actual embodiment (assuming that the functionality of the system is not adversely affected).

Figure 1:
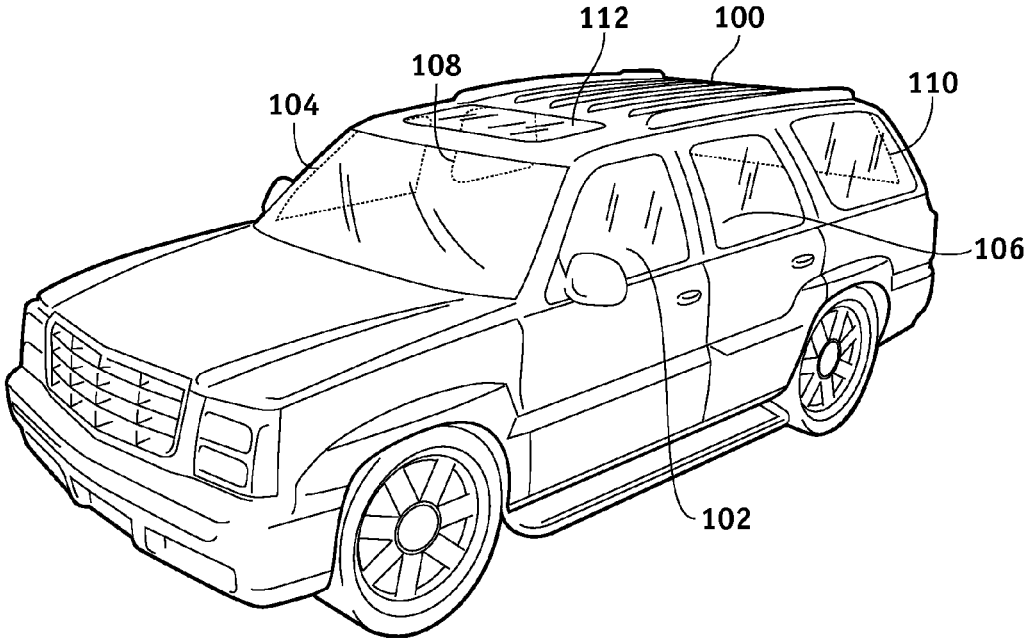
FIG. 1 is a perspective view of a vehicle with power windows.

FIG. 1 is a perspective view of a vehicle 100. FIG. 1 depicts a typical operating environment for a system for reducing a wind pressure pulsation as described in more detail below. In practice, the techniques and concepts described herein can be equivalently applied to other vehicle configurations, and the description of vehicle 100 is not intended to be limiting or restrictive in any way. Vehicle 100 has power windows 102 and 104. Power window 102 is the left front window and power window 104 is the right front window. The left front window 102 and right front window 104 (individually or collectively) may be referred to herein as the front side windows. This particular vehicle 100 has additional power windows: a rear left window 106, a rear right window 108, a rear window 110, and a sunroof 112. The left rear window 106 and right rear window 108 (individually or collectively) may be referred to herein as the rear side windows. Each power window is configured to allow a user to adjust the position of the window through the use of a button or switch. Vehicle may also include any number of additional power windows (not shown in FIG. 1). The general operation and control of power windows is well known, and as such will not be described in detail here.

If vehicle 100 is traveling at a sufficient rate of speed, and if one or more of the power windows are positioned within a specific range of non-closed positions, then persons within the interior passenger cabin of vehicle 100 may experience the buffeting effects of an air pressure oscillation, or wind pressure pulsation, within the passenger cabin of the vehicle. The wind pressure pulsation may be accompanied by a loud audible vibration, and may cause passenger discomfort and driver distraction. Certain combinations of vehicle speed and window position may intensify the wind pressure pulsation. For example, in vehicle 100, a slight wind pressure pulsation may be present within the passenger cabin when the vehicle is traveling at thirty miles per hour, the front side windows are closed, and one of the rear side windows is open half way while the other is closed. Moreover, the wind pressure pulsation may be intensified if the vehicle speed is increased, the open rear side window is opened further, or if the other rear side window is opened.

An existing wind pressure pulsation may be reduced by slowing the vehicle or by partially or fully closing all open power windows of the vehicle. Alternately, it may be possible to substantially reduce the wind pressure pulsation without reducing the vehicle speed or closing any power windows, by partially opening one or more closed power windows. Recalling the previous example, where the vehicle is traveling at a rate of thirty miles per hour, the front side windows are closed, and one of the rear side windows is open half way, the resulting wind pressure pulsation can be substantially reduced by partially opening one or more of the front side windows. For example, if rear right window 108 were opened more than half way, resulting in a wind pressure pulsation, the wind pressure pulsation could be substantially reduced by partially opening the previously closed left front window 102. Notably, prior art vehicle power window systems require manual intervention to substantially reduce a wind pressure pulsation.

A system and method for automatically reducing a wind pressure pulsation present in the passenger cabin of a vehicle as described herein addresses the limitations of prior art systems by monitoring and detecting conditions indicative of a pressure pulsation and automatically repositioning one or more power windows to reduce or eliminate the pressure pulsation. The technique may be realized in the form of a processing algorithm that uses vehicle speed data and window position data to predict the presence of a pressure pulsation within the vehicle's passenger cabin. The system achieves accuracy by predicting the presence of a pressure pulsation based on the known aerodynamic properties of the particular model of vehicle. In this regard, the particular functionality of the system can be calibrated for optimized performance on a vehicle-by-vehicle (or model-by-model) basis.

FIG. 2 is a schematic representation of an embodiment of a system 200 for reducing a wind pressure pulsation in the passenger cabin of a vehicle. System 200 generally includes a plurality of power windows 202; a power window controller 210 coupled to power windows 202; a plurality of window position sensors 203, each window position sensor being coupled to a respective power window; a vehicle speed sensor 208; and a control module 204. An embodiment of system 200 may also include additional environment sensors 214, a manual override system 212, and an apparatus for user input 216. Control module 204 may be coupled to the various features and components using suitable data communication links and suitable data communication protocols. System 200 may work in conjunction with a vehicle's power windows system or may be incorporated into the vehicle's power windows system.

Control module 204 may be implemented or performed with a general purpose processor, a content addressable memory, a digital signal processor, an application specific integrated circuit, a field programmable gate array, any suitable programmable logic device, discrete gate or transistor logic, discrete hardware components, or any combination thereof, designed to perform the functions described herein. A processor may be realized as a microprocessor, a controller, a microcontroller, or a state machine. A processor may also be implemented as a combination of computing devices, e.g., a combination of a digital signal processor and a microprocessor, a plurality of microprocessors, one or more microprocessors in conjunction with a digital signal processor core, or any other such configuration. In practical embodiments, control module 204 is implemented in an electronic control module (ECM) of the host vehicle.

For simplicity, the following description assumes that system 200 employs a single user input 216. In practice, system 200 can utilize any number of user inputs 216. User input 216 is configured to provide data indicative of a user's command. The user's command may be realized as the manual actuation of a button or switch, a voice command, or any other such human action intended to achieve a desired result. User input 216 sends data to power window controller 210 in a format understood by the power window controller. A typical vehicle deployment will include N user inputs 216 (such as a buttons or switches) that respectively correspond to one of N power windows 202. In other words, each power window 202 can be controlled by a respectively assigned user input 216.

FIG. 2 depicts system 200 in a configuration that utilizes N power windows 202. For a typical vehicle, an embodiment of system 200 includes four power windows 202 (front left, front right, rear left, and rear right). Each window of power windows 202 is an unfixed window capable of being opened and closed. Each power window 202 is coupled to a power window regulator (not shown separately in FIG. 2), where the power window regulator is configured to mechanically reposition the associated power window. Each power window regulator may be implemented as an electrically or pneumatically-operated device, or as any other powered device utilized to reposition the power window.

Power window controller 210 is configured to control the opening and closing of power windows 202. In practice, power window controller 210 receives data from user input 216 and controls the repositioning of power windows 202 accordingly. As described in more detail below, power window controller 210 may also be suitably configured to support automatic power window repositioning to alleviate wind pressure pulsation within the passenger cabin.

Window position sensors 203 are configured to generate window position data 205 corresponding to current positions of power windows 202, and may be realized as any suitable source that provides current window position data to system 200. In practice, window position sensors 203 may be implemented in power windows 202 and/or in power window controller 210, or in any other subsystem in which the window positions can be detected. The window position data may indicate, for example, a percentage relative to the fully closed (i.e., 100% closed, or 0% open) or the fully opened (i.e., 100% open, or 0% closed) position, or a distance relative to the fully closed position, the fully opened position, or any reference position. This embodiment of system 200, as depicted in FIG. 2, has M window position sensors 203. In practice, system 200 can use any number of window position sensors. Since system 200 need not require knowledge of the position of each power window to function properly, some power windows may not be associated with a window position sensor (e.g., M need not equal N). Window position sensors 203 send window position data 205 to control module 204 in a format that can be understood by the control module 204.

Vehicle speed sensor 208 (e.g., a sensor that drives a speedometer that indicates miles per hour) is configured to generate speed data 209 corresponding to the current speed of the vehicle, and may be any suitable source that provides the vehicle's current speed to system 200. Vehicle speed sensor 208 sends speed data 209 to control module 204 in a format that can be understood by the control module.

Environment sensors 214 are configured to generate environment data 215. Environment data 215 may comprise rain detection data, outside air temperature data, windshield wiper status data, and/or any other data representing the vehicle's current physical environment or vehicle state. In certain embodiments, an environment sensor 214 can be realized as a passenger cabin air pressure sensor that generates data indicative of a passenger cabin air pressure measurement. Such a pressure sensor can be used by system 200 to directly measure wind pressure pulsation in lieu of the detection of a condition or state that indicates a wind pressure pulsation in the cabin. Environment sensors 214 may be any suitable source or sources that provide data to control module 204 in a format that can be understood by the control module.

Control module 204 is coupled to power window controller 210, window position sensors 203, and vehicle speed sensor 208. As described in more detail below, control module 204 is generally configured to receive window position data 205 from the window position sensors 203 and speed data 209 from the vehicle speed sensor 208, to process the sensor data, and to instruct the power window controller to reposition one or more of power windows 202 to respective non-closed positions if window position data 205 and speed data 209 together indicate a wind pressure pulsation condition within the passenger cabin of the vehicle.

Generally, the intensity of such a wind pressure pulsation is a function of the vehicle speed, the window positions, and the vehicle's aerodynamic properties. Thus, given the vehicle's inherent aerodynamic properties, the intensity of a wind pressure pulsation can be predicted using window position data 205 and speed data 209. The reduction in the intensity of the wind pressure pulsation to be realized from partially opening any of power windows 202 found in the closed position can also be predicted. A greater reduction in intensity may be achieved by opening certain closed windows by particular amounts. In general, control module 204 is configured to determine, as a function of window position data 205 and speed data 209, whether to instruct power window controller 210 to reposition one or more of power windows 202 to particular non-closed positions, wherein each of the particular non-closed positions is a function of window position data 205 and speed data 209.

In response to user input 216, manual override system 212 may enable a user to temporarily disable further instructions by control module 204 to automatically reposition power windows 202. Manual override system 212 may be initiated by the use of a manual override command. A manual override command may be issued when an occupant of the vehicle provides user input 216. In one particular embodiment of the invention, user input 212 is provided by the manual actuation by the user of a power window control switch, made in the user's effort to manually adjust the position of a power window 202. Manual override system 212 may be configured such that, after control module 204 instructs power window controller 210 to reposition a power window 202 to a particular non-closed position, if the user then utilizes user input 216 to further adjust the power window, then manual override system 212 prevents control module 216 from issuing further commands to automatically reposition that power window (or, alternatively, any power window) for purposes of wind pressure pulsation relief.

Figure 3:
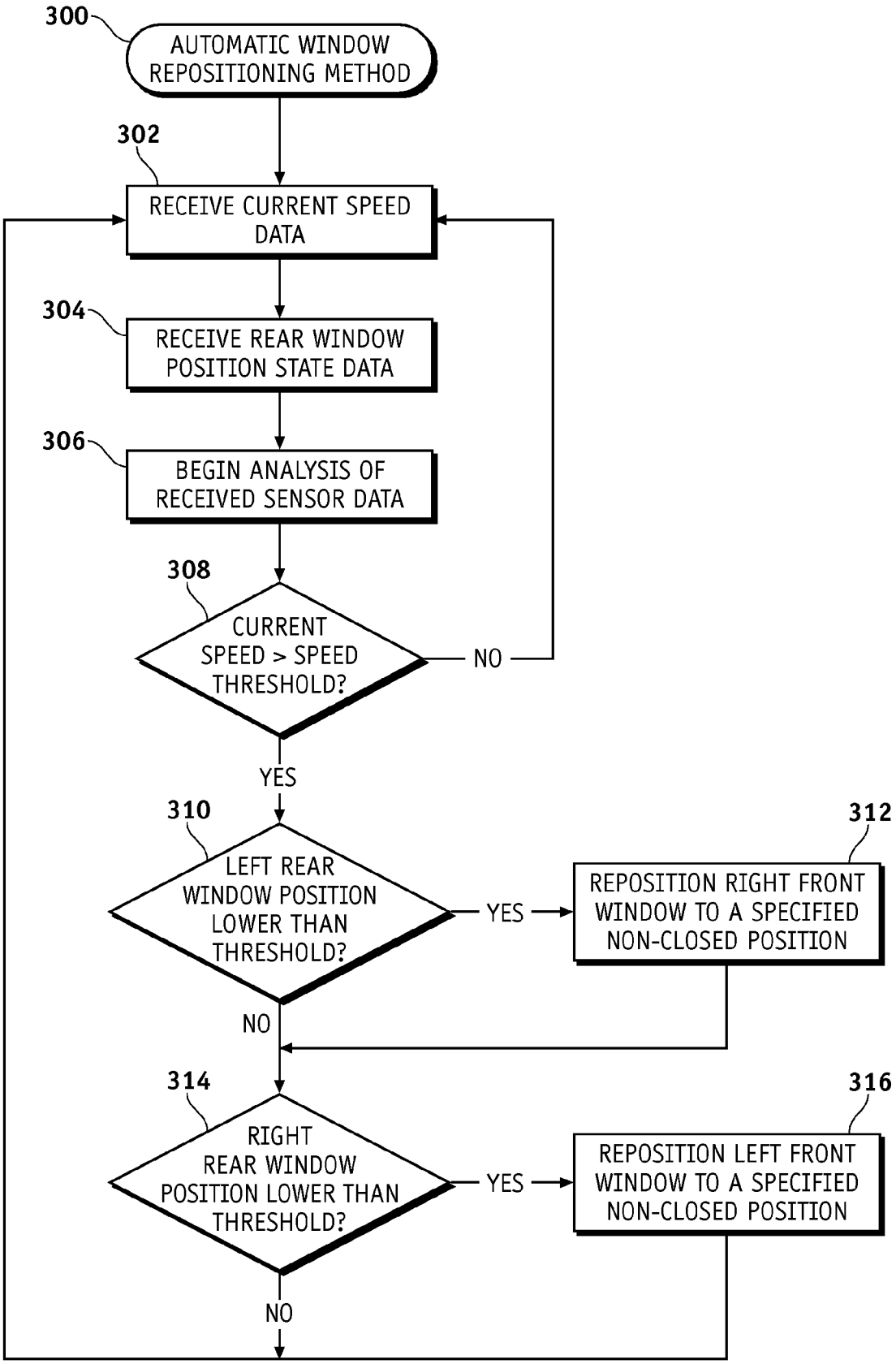
FIG. 3 is a flow chart that illustrates an embodiment of an automatic window repositioning process.

FIG. 3 is a flow diagram of an automatic window repositioning method 300 suitable for use with an exemplary embodiment of the invention. It should be appreciated that a practical system to reduce a wind pressure pulsation may utilize a different processing algorithm (or algorithms) and that method 300 is merely one example algorithm. The various tasks performed in connection with method 300 may be performed by software, hardware, firmware, or any combination thereof. For illustrative purposes, the following description of process 300 may refer to elements mentioned above in connection with FIGS. 1-2. In practical embodiments, portions of method 300 may be performed by different elements of the described system, e.g., control module 204 or power window controller 210. It should be appreciated that method 300 may include any number of additional or alternative tasks, the tasks shown in FIG. 3 need not be performed in the illustrated order, and method 300 may be incorporated into a more comprehensive procedure or process having additional functionality not described in detail herein.

For this example, automatic window repositioning method 300 operates on four power windows located on the sides of a vehicle: a left front window, a right front window, a left rear window, and a right rear window. Method 300 reads current vehicle speed data and rear window position data, and then analyzes the data to detect a condition indicative of a wind pressure pulsation in the vehicle passenger cabin. If the current speed and rear window position data indicate a wind pressure pulsation, method 300 lowers one or more of the front windows to respective non-closed positions to reduce the wind pressure pulsation. For the purposes of the following description, it is assumed that both front windows are initially in their closed positions or are partially lowered to points not beyond their respective non-closed positions used during automatic repositioning.

Method 300 begins by receiving current speed data from the vehicle speed sensor (task 302). In addition, method 300 receives rear window position state data from the rear window position sensors (task 304). Once the current speed data and rear window position state data are received, method 300 begins analysis of the received sensor data to detect conditions indicative of a wind pressure pulsation (task 306).

It is noteworthy that, in the particular embodiment illustrated by method 300, a wind pressure pulsation with the vehicle passenger cabin is not detected by measuring an air pressure oscillation directly, but is predicted based upon the current speed and rear window positions of the vehicle. Method 300 achieves accuracy by predicting the presence of a pressure pulsation based on the known aerodynamic properties and/or other known characteristics of the particular model of vehicle. In another practical embodiment, data received from an air pressure sensor located within the vehicle passenger cabin is used to directly detect the presence of a wind pressure pulsation within the vehicle passenger cabin. Air pressure data received from the air pressure sensor is observed over time to identify a wind pressure pulsation. Air pressure sensor data may be analyzed independent from or in conjunction with data from additional sensors, such as a vehicle speed sensor and/or window position sensors. Data provided by such additional sensors can increase accuracy in determining the presence of a wind pressure pulsation over a determination based upon air pressure sensor data alone.

Generally, it is necessary that a vehicle travel at a rate beyond a specific speed threshold for a wind pressure pulsation to develop in the vehicle's passenger cabin. Accordingly, an initial query in the sensor data analysis is whether the current speed data received indicates that the vehicle is traveling at a rate beyond a specific speed threshold (task 308). If not, then the method 300 presumes that a wind pressure pulsation does not exist, further analysis of received sensor data is skipped, and method 300 loops back to task 302 to begin the method anew. Otherwise, method 300 assumes that the current speed data satisfies one condition corresponding to a wind pressure pulsation, and task 310 is performed next.

To predict a wind pressure pulsation once the requisite vehicle speed condition is satisfied, it is sufficient to show that the left rear window and/or right rear window are lowered beyond a specific position threshold. Accordingly, one query in the sensor data analysis is whether the received rear window position state data indicates that the left rear window is lowered beyond a specific position threshold (task 310). If so, then a wind pressure pulsation is indicated, the right front window is repositioned to a specified non-closed position to reduce or eliminate the pressure pulsation (task 312), and then task 314 is performed. Otherwise, task 314 is performed immediately. Similar steps are performed for the right rear window to conditionally reposition the left front window. If the rear window position state data indicates that the right rear window is lowered beyond the specific position threshold required for a wind pressure pulsation to occur (task 314), then a wind pressure pulsation is indicated, the left front window is repositioned to a specified non-closed position to reduce or eliminate the wind pressure pulsation (task 316), and then task 302 is performed. Otherwise, task 302 is performed immediately. Task 302 begins another iteration of method 300, enabling method 300 to operate continuously.

Assume that the vehicle is traveling faster than the designated speed threshold (for example, 35 MPH). If the left rear window is lowered beyond the threshold position (for example, beyond the midpoint), then the right front window will be automatically lowered to the designated index point (for example, 0.5 inch down from the fully closed position). Similarly, if the right rear window is lowered beyond the threshold position (for example, beyond the midpoint), then the left front window will be automatically lowered to its designated index point (for example, 0.5 inch down from the fully closed position). The opening of the diagonally opposing front windows is effective at reducing or eliminating the wind pressure pulsation effect. An alternate embodiment may be suitably configured such that both front windows are automatically repositioned in response to the lowering of either rear window beyond the respective threshold position. Yet another embodiment may be suitably configured such that the right front window is automatically repositioned in response to the lowering of the right rear window beyond its threshold position (and such that the left front window is automatically repositioned in response to the lowering of the left rear window beyond its threshold position). Indeed, these different operating methodologies may be selectable by the user or manufacturer of the vehicle. Moreover, the specific operating methodology utilized by a given vehicle may be influenced by its aerodynamic properties, its body configuration, its window configuration, and/or other physical characteristics that might contribute to the creation of the cabin pressure pulsation effect.

For a given vehicle model, the reduction in the intensity of the wind pressure pulsation to be realized by method 300 depends not only upon the current vehicle speed and rear window positions, but on the position to which a front window is lowered. In the example of method 300, for a given current vehicle speed and left rear window position, which together indicate a wind pressure pulsation, repositioning the right front window to varying positions results in a varying reduction in the intensity of the wind pressure pulsation in the vehicle passenger cabin. Accordingly, the reduction in the intensity of a wind pressure pulsation achieved in task 312 can be increased or maximized by repositioning the right front window to a specified non-closed position, wherein the particular non-closed position is a function of the rear window position and the current speed of the vehicle. An analogous function can be implemented to reposition the left front window in task 316. Those skilled in the art will appreciate that it may be worthwhile to take steps to initially reposition a front window to a position determined as a function of current vehicle speed and rear window position, but to then prevent further automatic repositioning of the front windows as vehicle speed and rear window positions change over time.

Figure 4:
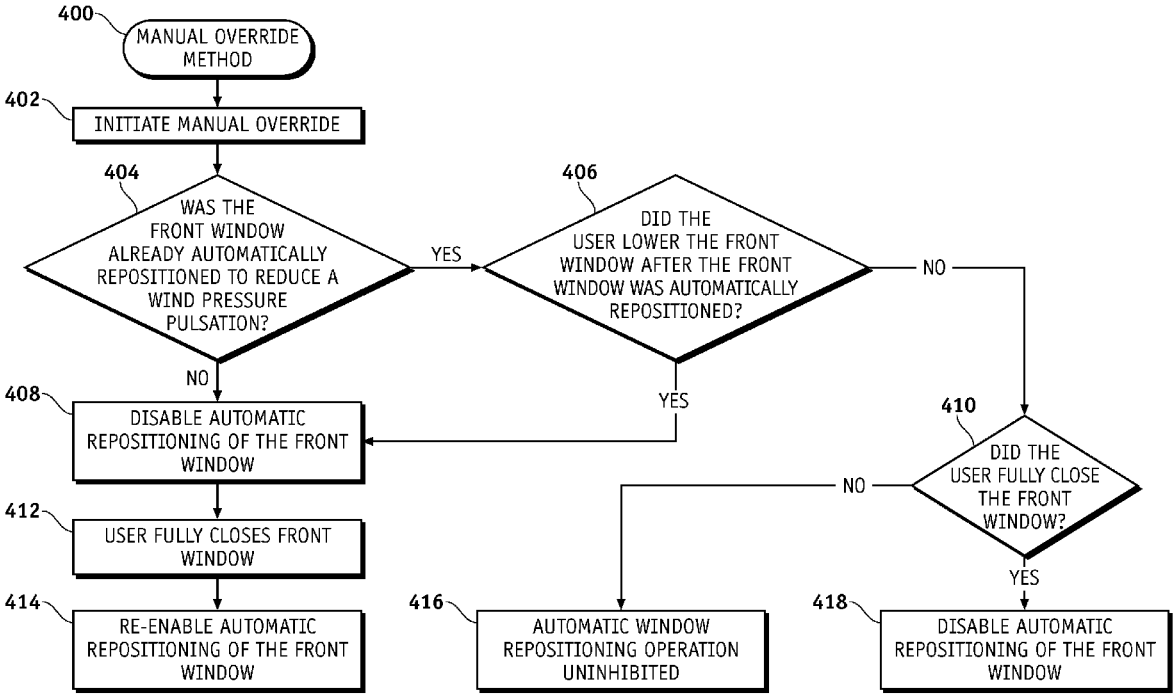
FIG. 4 is a flow chart that illustrates an embodiment of a manual override process.

FIG. 4 is a flow diagram of a manual override method 400 suitable for use with an exemplary embodiment of the invention. For descriptive purposes, manual override method 400 is described in conjunction with the operation of automatic window repositioning method 300, but it should be appreciated that manual override method 400 may work in conjunction with other automatic window repositioning methods. It should further be appreciated that a practical manual override system may utilize a different processing algorithm (or algorithms) and that method 400 is merely one example algorithm. The various tasks performed in connection with method 400 may be performed by software, hardware, firmware, or any combination thereof. For illustrative purposes, the following description of process 400 may refer to elements mentioned above in connection with FIGS. 1, 2, and 3. In practical embodiments, portions of method 400 may be performed by different elements of the described system, e.g., control module 204 or power window controller 210. It should be appreciated that method 400 may include any number of additional or alternative tasks, the tasks shown in FIG. 4 need not be performed in the illustrated order, and method 400 may be incorporated into a more comprehensive procedure or process having additional functionality not described in detail herein.

A vehicle user may operate the power window controls to manually reposition a front window to a desired location, and upon manual repositioning, the user may wish that method 300 not further reposition the front window. Alternatively, the user may wish to undo the automatic repositioning of a front window (i.e., close the window) after it is automatically repositioned by method 300. Manual override method 400 complements the operation of method 300 by enabling a vehicle user to temporarily disable the automatic window repositioning function performed by method 300. In this example, manual override method 400 operates on four power windows located on the sides of a vehicle: a pair of front windows and a pair of rear windows.

Manual override is initiated when a vehicle user operates the power window controls to manually reposition a front window. If manual override is initiated prior to the automatic repositioning of the front window to reduce a wind pressure pulsation, then method 400 temporarily disables automatic repositioning by method 300. If manual override is initiated after the automatic repositioning of the front window, then method 400 temporarily disables automatic repositioning by method 300 if the user commands the system to either further open or fully close the front window. If automatic repositioning is disabled and the front window is in a non-closed position, then automatic repositioning of the front window is re-enabled when the user commands the front window to fully close.

For this embodiment, manual override of the automatic window positioning system for a particular front window is initiated when the vehicle user operates the power window controls to manually reposition the front window. Accordingly, when the user operates the power window controls for a particular front window, method 400 initiates manual override for that window (task 402).

The manual override procedure performed by method 400 depends upon whether the front window is in its automatically repositioned state at the time manual override is initiated. If the front window is in its automatically repositioned state when manual override is initiated (task 404), then task 406 is performed. In this situation, the query is whether the user lowered the front window further (task 406). If so, then task 408 is be performed. Otherwise, the "NO" branch of task 406 indicates that the user raised the front window, and task 410 is be performed.

Task 408 is performed if query task 404 determines that the front window is not in its automatically repositioned state, or if query task 406 determines that the user raised the front window above its automatically repositioned state. In either case, task 408 temporarily disables automatic repositioning of the front window. Thereafter, if the vehicle user fully closes the front window (task 412), method 400 re-enables automatic repositioning of the front window (task 414).

As explained above, the "NO" branch of query task 406 is followed if the user raises the front window after it has been automatically repositioned. Accordingly, task 410 queries whether the user fully closed the front window. If so, then automatic repositioning of the front window is disabled (task 418), and the user's command trumps overrides the automatic repositioning feature. Otherwise, the "NO" branch of query task 410 indicates that the user partially closed the front window, method 400 neither enables nor disables automatic window positioning, and automatic window repositioning method 300 is allowed to operate uninhibited (task 416).

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing the exemplary embodiment or exemplary embodiments. It should be understood that various changes can be made in the function and arrangement of elements without departing from the scope of the invention as set forth in the appended claims and the legal equivalents thereof.

What is claimed is:

1. A system to reduce a wind pressure pulsation in a passenger cabin of a vehicle, the system comprising:

a plurality of power windows;

a plurality of window position sensors, the window position sensors being configured to generate window position data corresponding to current positions of the power windows;

a power window controller for the power windows;

a vehicle speed sensor configured to generate speed data corresponding to a current speed of the vehicle; and a control module coupled to the window position sensors, the power window controller, and the vehicle speed sensor, the control module being configured to:

receive the window position data from the window position sensors and the speed data from the vehicle speed sensor; and instruct the power window controller to reposition one or more of the power windows to respective non-closed positions if the window position data and speed data together indicate a wind pressure pulsation condition within the passenger cabin of the vehicle.

2. The system of claim 1, wherein the control module is configured to determine, as a function of the window position data and the current speed of the vehicle, whether to instruct the power window controller to reposition the one or more of the power windows.

3. The system of claim 2, wherein the control module is configured to instruct the power window controller to reposition the one or more of the power windows to particular non-closed positions, wherein each of the particular non-closed positions is a function of the window position data and the current speed of the vehicle.

4. The system of claim 1, further comprising a manual override system configured to allow a user of the vehicle to manually adjust the one or more of the power windows from the respective non-closed positions.

5. The system of claim 4, wherein the manual override system is configured to temporarily disable automatic repositioning of the power windows in response to a manual override command.

6. A method of reducing a wind pressure pulsation in a vehicle having front windows, rear windows, a vehicle speed sensor, and window position sensors for the rear windows, the method comprising:

detecting conditions indicative of the wind pressure pulsation, based on a current speed received from the vehicle speed sensor and a rear window position state obtained from the window position sensors; and in response to the detecting step, automatically repositioning one or more of the front windows to respective non-closed positions to reduce the wind pressure pulsation.

7. The method of claim 6, further comprising determining, as a function of the rear window position state and the current speed, whether to reposition the one or more of the front windows.

8. The method of claim 7, wherein repositioning the one or more of the front windows comprises repositioning the one or more of the front windows to particular non-closed positions, wherein each of the particular non-closed positions is a function of the rear window position state and the current speed.

9. The method of claim 6, further comprising:

receiving a manual override command for a specified front window of the vehicle; and in response to the manual override command, adjusting the specified front window from its non-closed position to a manual override position.

10. The method of claim 9, further comprising temporarily disabling automatic repositioning of the front windows, wherein the manual override command initiates the disabling.

11. The method of claim 6, wherein:

the vehicle has a front left window, a front right window, a rear left window, and a rear right window;

detecting conditions indicative of the wind pressure pulsation is based on the current speed and the rear window position state of the rear left window; and automatically repositioning one or more of the front windows comprises automatically repositioning the front right window.

12. The method of claim 6, wherein:

the vehicle has a front left window, a front right window, a rear left window, and a rear right window;

detecting conditions indicative of the wind pressure pulsation is based on the current speed and the rear window position state of the rear right window; and automatically repositioning one or more of the front windows comprises automatically repositioning the front left window.

* * * * *